US011560655B2

(12) United States Patent
Xie et al.

(10) Patent No.: US 11,560,655 B2
(45) Date of Patent: Jan. 24, 2023

(54) HEMMING-STITCH-FREE WARP-KNITTED ELASTIC FABRIC AND METHOD FOR KNITTING THEREOF

(71) Applicant: Pacific (Panyu) Textiles Ltd., Guangdong (CN)

(72) Inventors: Xiangjiao Xie, Guangdong (CN); Changsheng Peng, Guangdong (CN); Lihong Qiu, Guangdong (CN); Ying Zhao, Guangdong (CN); Wenzheng Xie, Guangdong (CN); Yan Shen, Guangdong (CN); Baohong Hu, Guangdong (CN); Yanhuan Deng, Guangdong (CN); Xue Xiao, Guangdong (CN); Feiyu Zhang, Guangdong (CN); Hualan Xu, Guangdong (CN)

(73) Assignee: Pacific (Panyu) Textiles Ltd., Guangzhou (CN)

( * ) Notice: Subject to any disclaimer, the term of this patent is extended or adjusted under 35 U.S.C. 154(b) by 446 days.

(21) Appl. No.: 16/702,532

(22) Filed: Dec. 3, 2019

(65) Prior Publication Data

US 2021/0032787 A1 Feb. 4, 2021

(30) Foreign Application Priority Data

Jul. 29, 2019 (CN) ..... 201910690557.5

(51) Int. Cl.
*D04B 21/20* (2006.01)
*A41B 9/00* (2006.01)
(Continued)

(52) U.S. Cl.
CPC ..... *D04B 21/207* (2013.01); *A41B 9/001* (2013.01); *A41B 17/00* (2013.01); *A41C 3/0057* (2013.01);
(Continued)

(58) Field of Classification Search
None
See application file for complete search history.

(56) References Cited

U.S. PATENT DOCUMENTS 2,535,376 A * 12/1950 Thompson, Jr. ..... D04B 23/08 87/7
4,307,587 A * 12/1981 Baesgen ..... D04B 21/18 66/195
(Continued)

FOREIGN PATENT DOCUMENTS

CN 201473695 U 5/2010
CN 206359730 U * 7/2017 ..... D04B 21/12
(Continued)

*Primary Examiner* — Khoa D Huynh
*Assistant Examiner* — Grace Huang

(57) ABSTRACT

The present invention discloses a hemming-stitch-free warp-knitted elastic fabric and a method for knitting thereof. The method includes: making a non-elastic yarn pass across a guide needle of the first guide bar and form the surface of the fabric by knitting via two needles or three needles in a 1×1 or 2×1 warp plain stitch loop mode, and making an elastic yarn pass across a guide needle of the second guide bar and form the inside of the fabric by knitting with the aforementioned non-elastic yarn in the same direction via three needles in a open double warp plain stitch loop mode, and two loops are continuously formed on each course of the open double warp plain stitch loop. The hemming-stitch-free warp-knitted fabric produced according to the present invention has good snagging grade, moderate horizontal straight tensile force and good resilience.

9 Claims, 6 Drawing Sheets

(51) Int. Cl.
*D04B 21/18* (2006.01)
*A41B 17/00* (2006.01)
*A41C 3/00* (2006.01)

(52) U.S. Cl.
CPC ..... *D04B 21/18* (2013.01); *D04B 21/20* (2013.01); *A41B 2500/10* (2013.01); *A41B 2500/50* (2013.01); *D10B 2201/02* (2013.01); *D10B 2331/02* (2013.01); *D10B 2331/021* (2013.01); *D10B 2331/04* (2013.01); *D10B 2331/06* (2013.01); *D10B 2331/12* (2013.01); *D10B 2401/061* (2013.01); *D10B 2501/02* (2013.01)

(56) References Cited

U.S. PATENT DOCUMENTS 5,787,503 A * 8/1998 Murphy, III ..... A41D 1/04 66/196
6,216,497 B1 * 4/2001 Miyata ..... A41B 17/00 66/202
7,051,556 B2 * 5/2006 Oya ..... D04B 21/18 66/172 E
7,854,022 B2 * 12/2010 Warren ..... A41B 9/001 2/401
7,905,118 B2 * 3/2011 Regenstein ..... D04B 21/18 66/195
9,232,823 B2 * 1/2016 Mitchell ..... A41B 9/001
9,279,201 B2 * 3/2016 Akita ..... D04B 21/18
9,850,601 B2 * 12/2017 Shen ..... D04B 21/06
2002/0162364 A1 * 11/2002 Relats ..... D04B 21/16 66/170
2004/0168479 A1 * 9/2004 McMurray ..... D04B 1/16 66/202
2009/0172858 A1 * 7/2009 Oya ..... D04B 21/207 2/338
2012/0124716 A1 * 5/2012 Toratani ..... A41D 7/005 2/228
2012/0297840 A1 * 11/2012 Yeung ..... D04B 21/18 66/195
2015/0128653 A1 * 5/2015 Yeung ..... D04B 21/18 66/204
2016/0215420 A1 * 7/2016 He ..... D04B 21/207
2019/0062963 A1 * 2/2019 Heiner ..... D04B 21/10
2020/0291556 A1 * 9/2020 Peng ..... D04B 21/20
2022/0047022 A1 * 2/2022 Almog ..... A41D 31/04
2022/0258450 A1 * 8/2022 Lawrence ..... D04B 21/08

FOREIGN PATENT DOCUMENTS

EP 3495540 A1 * 6/2019 ..... D04B 21/18
GB 1235134 A * 6/1971 ..... D04B 21/12
JP 2003147618 A * 5/2003 ..... D04B 21/18
JP 2004169262 A 6/2004
WO WO-2010089167 A2 * 8/2010 ..... D04B 21/18

* cited by examiner

HEMMING-STITCH-FREE WARP-KNITTED ELASTIC FABRIC AND METHOD FOR KNITTING THEREOF

CROSS REFERENCE TO RELATED APPLICATIONS

The present application claims priority to and the benefit of Chinese Patent Application No. 201910690557.5 filed on Jul. 29, 2019, the contents of which are incorporated herein by reference in their entirety.

TECHNICAL FIELD

The present invention belongs to the field of knitted fabrics and particularly relates to a hemming-stitch-free warp-knitted elastic fabric and a method for knitting thereof.

BACKGROUND

It is well known that the edges of a lower hem and the like of an apparel fabric generally need to be folded into two layers for stitching, or need to subjected to edge processing (hemming-stitch) of stitching with other fabrics and thread strips, but if such edge processing is performed, the broken edge will become thicker, affecting the appearance of the product; the skin in contact with the edge will be subjected to compression friction or airtightness and the like, and thus it is not desirable to perform edge processing during the processing of the apparel fabric.

Recently, free-cut fabrics are free-cut fabrics that have recently received more attention from the market, and are also called arbitrarily-cut fabrics. The free-cut fabrics are each usually a four-sided elastic fabric made of a chemical fiber and spandex. The knitting raw materials are generally nylon fiber and low-temperature spandex. The fabric produced has the advantages of no curling, no raveling and no thread dropping, and the like, can be cut freely, and has a softer and smoother hand feeling than a fabric cut traceless.

A structural fabric disclosed in JP-A-2004-169262 has certain requirements for an elastic yarn used, and low-temperature spandex must be used, and there are certain requirements for the setting temperature thereof; otherwise the problem of raveling is likely to occur, resulting in one fabric being divided into two.

CN201473695U discloses an elastic fabric, which has a doubling knitted structure and is knitted by combining at least one strand of elastic yarns and at least one strand of non-elastic yarns. The non-elastic yarn is a polyester yarn or a cotton yarn, and the elastic yarn is a spandex yarn. The elastic fabric of the utility model not only incorporates the elastic yarn in the knitting process, but also combines a unique doubling knitting structure. The elastic fabric has a very good elastic force, and the fabric surface has an attractive pattern. However, the edge of the fabric still needs to be subjected to edge processing.

SUMMARY

In view of the deficiencies of the prior art, objectives of the present invention are to provide a hemming-stitch-free warp-knitted elastic fabric and a method for knitting thereof.

The warp-knitted fabric has good resilience, can be arbitrarily cut, does not ravel easily, and is free of hemming-stitch.

The first objective of the present invention is to provide the method for knitting a hemming-stitch-free warp-knitted elastic fabric. Only by means of a knitting structure, the knitting process maintains an original cutting state without edge processing and laser cutting and without heating bonding processing, can prevent yarn breakage and fabric ravelling more reliably, and can greatly reduce cost, which will improve product competition to a certain extent.

To achieve this objective, the present invention adopts the following technical solution:

A method for knitting a hemming-stitch-free warp-knitted elastic fabric, which uses a first guide bar and a second guide bar of a warp knitting machine for knitting, includes:

making a non-elastic yarn pass across a guide needle of the first guide bar and form the surface of the fabric by knitting in a 1×1 or 2×1 tricot stitch loop, and making an elastic yarn pass across a guide needle of the second guide bar and form the inside of the fabric by knitting with the aforementioned non-elastic yarn in the same direction in a open double loop stitch, and two loops are continuously formed on each course of the open double warp plain stitch loop.

Preferably, modes for threading of the first guide bar and the second guide bar are full-set threading.

In the knitting method provided by the present invention, the non-elastic yarn and the elastic yarn are knitted in the same direction to form a double-sided structure; and the made warp-knitted elastic fabric has good resilience, can be arbitrarily cut, can reliably prevent yarn breakage, does not ravel easily, and is free of hemming-stitch.

In the present invention, the elastic yarn and the non-elastic yarn must be knitted in a same-direction knitting structure mode; otherwise the formed fabric may be curled due to tension.

The non-elastic yarn is a synthetic fiber and/or a natural fiber, and has a fineness of 11-85 dtex. For example, the non-elastic yarn has a fineness of 11 dtex, 15 dtex, 22 dtex, 33 dtex, 44 dtex, 56 dtex, 66 dtex, 75 dtex, 77 dtex, and 85 dtex. Further preferably, the non-elastic yarn has a fineness of 11-44 dtex. For example, the non-elastic yarn has a fineness of 11 dtex, 15 dtex, 22 dtex, 33 dtex, and 44 dtex.

The synthetic fiber is a natural fiber, or a blended yarn formed of a synthetic fiber and a natural fiber; and further, the synthetic fiber is any one or a mixture of at least two of a nylon filament, a polyester filament, and a cotton thread. For example, the synthetic fiber is a blended yarn of the nylon filament and the polyester filament, or a blended yarn of the nylon filament and the cotton thread, or a blended yarn of the polyester filament and the cotton thread, or a blended yarn of the nylon filament, the polyester filament and the cotton thread.

Although when the elastic yarn is thinner, it is easier to increase the density of the fabric, if the elastic yarn is too fine, the strength is weak. The elastic yarn is a spandex yarn with a fineness of 22-77 dtex. For example, the fineness of the elastic yarn is 22 dtex, 25 dtex, 30 dtex, 35 dtex, 40 dtex, 45 dtex, 50 dtex, 55 dtex, 60 dtex, 65 dtex, 70 dtex, 75 dtex, or 77 dtex, preferably 33-77 dtex. For example, the fineness of the elastic yarn is 33 dtex, 35 dtex, 40 dtex, 45 dtex, 50 dtex, 55 dtex, 60 dtex, 65 dtex, 70 dtex, 75 dtex, or 77 dtex.

In addition, if the finished product requires a soft and delicate cloth cover, a first guide bar threads the non-elastic yarn via a two-needle warp plain stitch structure, and a finer yarn count of a spandex yarn should be selected as far as possible. When a gray fabric is knitted on a machine, it should be specially noted that the fabric edge should be slightly widened, and an edge supporting device should be used. Therefore, the fabric edge of the gray fabric of this type of structure is relatively curled, so it is necessary to widen the edge slightly for the convenience of gray fabric weaving and fabric rolling, and an edge blower is used. Further, from the viewpoint of preventing occurrence of curling, it is preferable that a braided fabric is not linear when cut, and preferably has a wave shape.

In the preceding text, several terms are explained as follows:

Warp plain stitch structure: The warp plain stitch structure is one of the most basic warp-knitted structures, and is in such a configuration that loops formed by the same yarn are alternately arranged in two adjacent loop wales.

Arbitrary cutting: When garments such as underwear and close-fitting clothes are sewn, a neckline, a lower hem and cuffs do not need to bind off, which improves the wearing comfort of the garments. The present invention achieves this performance by utilizing a special knitting structure.

Ravelling property: The ravelling property refers to the phenomenon that loops are separated from each other when a yarn of a knitted fabric breaks or loses an interlacing connection. Once a loop breaks, the wales will be ravelled from top to bottom, causing one fabric to be divided into two.

Closed warp plain stitch structure: The closed warp plain stitch structure is such a configuration that two extension lines of a loop formed by the same yarn intersect and overlap at a base of the loop.

Open warp plain stitch structure: The open warp plain stitch structure is such a configuration that two extension lines of a loop formed by the same yarn do not intersect and overlap at a base of the loop.

Open double loop stitch structure: A warp-knitted structure in which one yarn continuously forms a loop over two needles on one course is called double loop stitch, and two extension lines of the open double loop stitch loop do not intersect and overlap at the base of the loop. The yarn laying digital is 0-2/3-1// or 3-1/0-2//.

The second objective of the present invention is to provide the hemming-stitch-free warp-knitted elastic fabric prepared by the knitting method of the first objective. The fabric is formed by knitting the non-elastic yarn and the elastic yarn in a same-direction knitting structure mode, and the produced warp-knitted fabric has good resilience, can be arbitrarily cut, can reliably prevent yarn breakage, does not ravel easily, and is free of hemming-stitch.

The third objective of the present invention is to provide a garment. At least a portion of a linear edge and/or a curved edge of the garment is composed of the hemming-stitch-free warp-knitted elastic fabric. The garment thus produced has good resilience.

For the hemming-stitch-free warp-knitted elastic fabric provided by the present invention, a dyeing and finishing process includes: refining a knitted fabric, and then dehydrating the fabric for the first time; after dehydration, executing a presetting process, and then performing dyeing treatment; drying the dyed fabric, and finally subjecting a finished product to setting, where the objective of refining is to remove impurities on the fabric, make the fabric white and soft and have good penetrating properties, and prepare for subsequent dyeing. A refining device is generally a cooking device, such as a cloth steam cooker. A first-time dehydration device includes a rolling dehydrator, or a vacuum dehydrator, a dryer, a centrifugal dehydrator, or the like; a presetting and setting device is a tentering setting machine; a dyeing device is a high temperature and high pressure dyeing machine, a skein dyeing machine, a sizing and dyeing combination machine, a spray dyeing device, a foam dyeing device, or the like; and a drying device is a dryer.

Compared with the prior art, the present invention has the following beneficial effects:

(1) Two kinds of yarns with a first guide bar/a second guide bar of the fabric provided by the present invention adopts the warp plain stitch structure combination, and the finished fabric meets the requirements for free cutting, and can meet the requirements on various occasions; the setting of guide bar full-set threading elastic yarn makes the hemming-stitch-free warp-knitted elastic fabric have excellent elasticity, and expands the range of practical applications. Moreover, the warp plain stitch structure combination makes the resilience and snagging grade of the fabric better. Specifically, the longitudinal elongation is 127-243%, the transverse elongation is 150-270%, the snagging grade is 3-3.5, the hand feeling is 3.5-4, the longitudinal resilience is 90-96%, and the transverse resilience is 92-95%. The hemming-stitch-free warp-knitted fabric obtained according to the present invention does not curl, can be freely cut, has good wearability, can be applied to underwear, corsets or sportswear, and has a good market prospect.

(2) Only by means of a knitting structure, the method for knitting the hemming-stitch-free warp-knitted fabric maintains an original cutting state without edge processing, without laser cutting and without heating bonding processing. The fabric can be produced by ordinary electric shears, and thus the cost is greatly reduced.

DESCRIPTION OF THE EMBODIMENTS

The present invention is implemented by using a commercially available warp knitting machine, and the basic structure thereof includes a let-off mechanism, a knitting mechanism, a guide bar traverse movement mechanism, a pulling and curling mechanism, a transmission mechanism, and the like. The knitting mechanism includes a needle bed, a first guide bar, a second guide bar, and the like.

Figure 1:
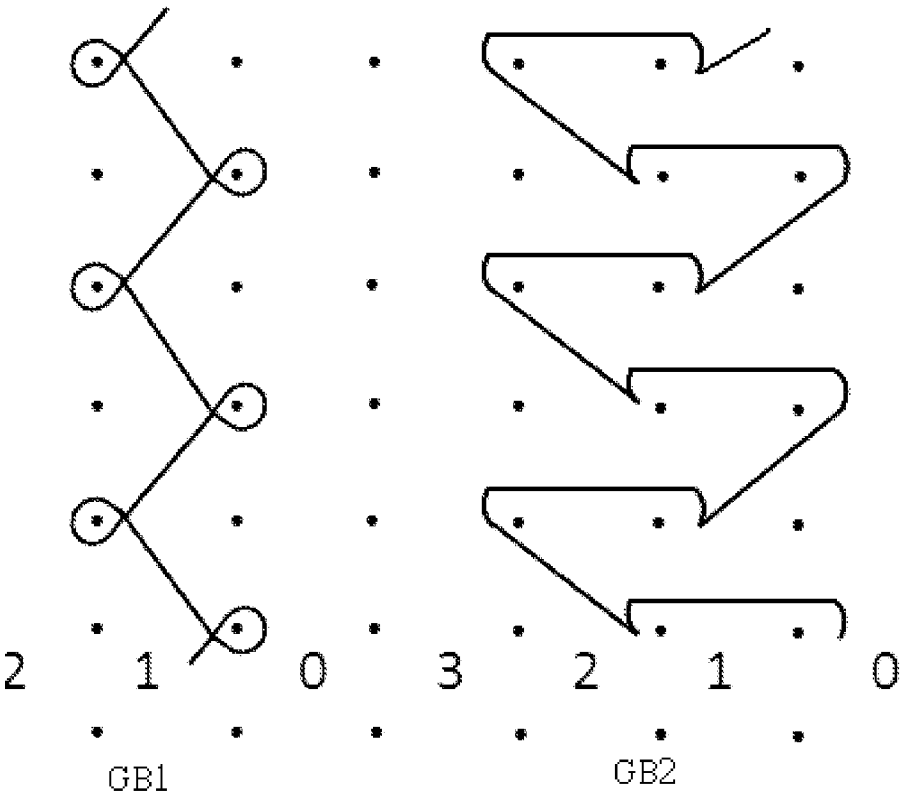
FIG. 1 is a first schematic structural diagram of a hemming-stitch-free warp-knitted fabric provided by the present invention.
Figure 2:
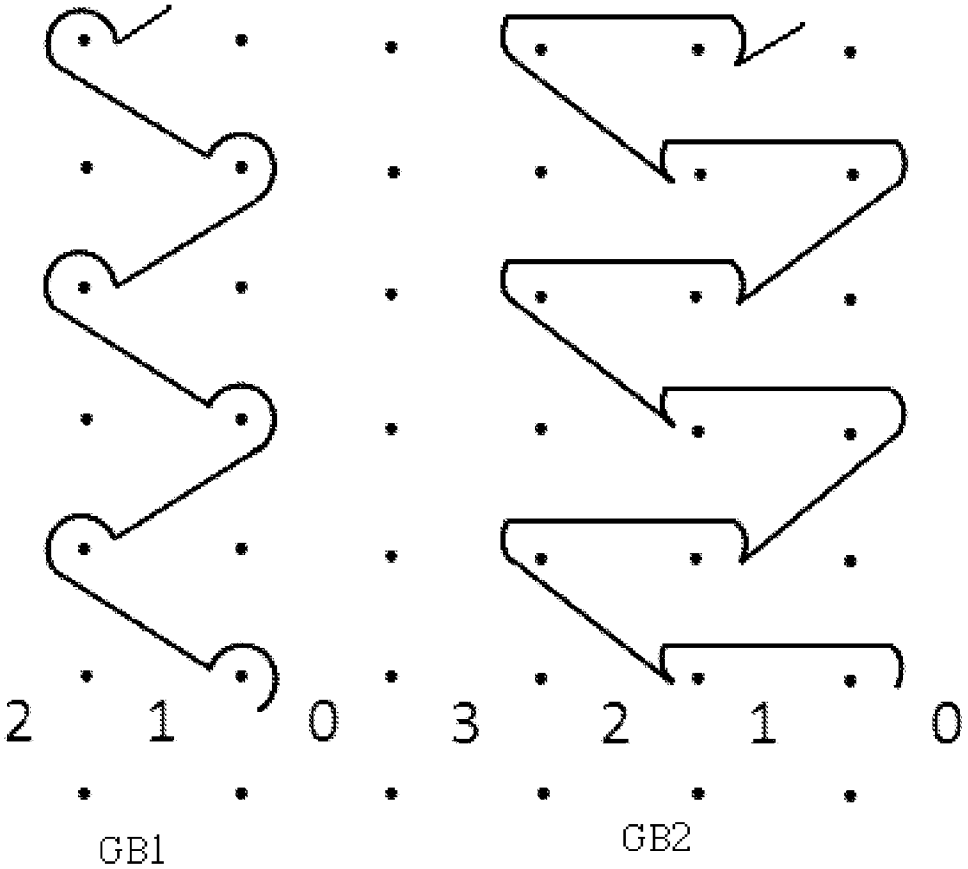
FIG. 2 is a second schematic structural diagram of a hemming-stitch-free warp-knitted fabric provided by the present invention.
Figure 3:
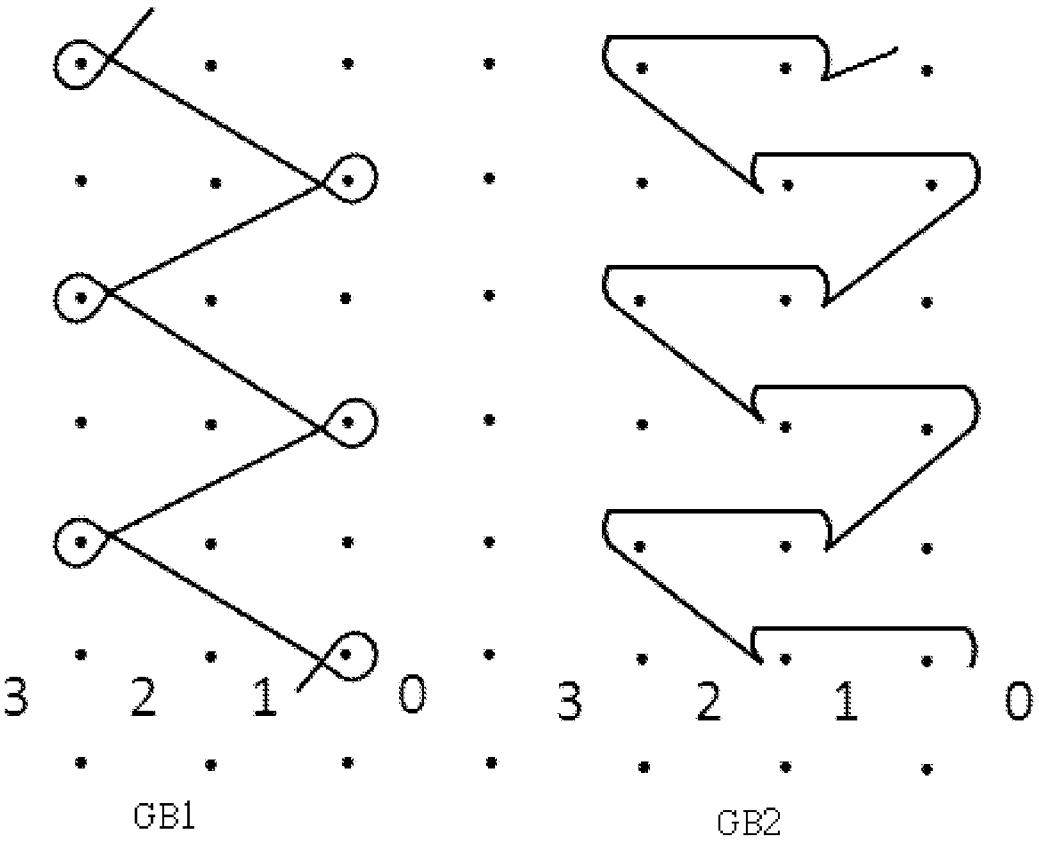
FIG. 3 is a third schematic structural diagram of a hemming-stitch-free warp-knitted fabric provided by the present invention.

The technical solution of the present invention will be further described below with reference to FIGS. 1 to 3 and by specific embodiments.

Embodiment 1

For a hemming-stitch-free warp-knitted elastic fabric provided by this embodiment, an adopted machine is a Karl Mayer HKS 2-S type tricot warp knitting machine with a machine number of E40. The number of guide bars is 2, and modes for threading of a first guide bar (GB1) and a second guide bar (GB2) are GB1/GB2 full-set threading.

Raw materials: a 22/34 dtex nylon matte straight yarn is selected for GB1, and a 22 dtex spandex yarn is selected for GB2.

A method for knitting a hemming-stitch-free warp-knitted elastic fabric provided by this embodiment includes: a non-elastic yarn passes across a guide needle of the first guide bar (GB1) and is knitted in a 1×1 closed warp plain stitch loop mode through two needles (the yarn laying digital is 1-0/1-2//), an elastic yarn passes across a guide needle of the second guide bar (GB2) and is knitted in a open double warp plain stitch loop mode in the same direction as the aforementioned non-elastic yarn, and two loops are continuously formed on each course of the open chain loop (the yarn laying digital is 0-2/3-1//), to form a hemming-stitch-free warp-knitted elastic fabric. The schematic structural diagram of the produced fabric is shown in FIG. 1.

A dyeing and finishing process includes: refining a knitted fabric in a steam cooker first to remove impurities on the fabric, make the fabric white and soft and have good penetrating properties, and prepare for subsequent dyeing, and then dehydrating the fabric for the first time through a vacuum dehydrator; after dehydration, entering into a tentering setting machine for presetting, and performing dyeing treatment through a sizing and dyeing combination machine; placing the dyed fabric in a dryer for drying, and finally subjecting a finished product to setting through a tentering setting machine. The steam cooker, the vacuum dehydrator, the tentering setting machine, the sizing and dyeing combination machine and the dryer described above are commercially available devices.

Embodiment 2

A hemming-stitch-free warp-knitted elastic fabric provided by this embodiment adopts a machine of Karl Mayer HKS 2-S type tricot warp knitting machine with a machine number of E40. The number of guide bars is 2, and modes for threading of a first guide bar (GB1) and a second guide bar (GB2) are GB1/GB2 full-set threading.

Raw materials: a 22/34 dtex polyester matte straight yarn is selected for GB1, and a 22 dtex spandex yarn is selected for GB2.

A method for knitting a hemming-stitch-free warp-knitted elastic fabric provided by this embodiment includes: a non-elastic yarn passes across a guide needle of the first guide bar (GB1) and is knitted in a 1×1 open warp plain stitch loop mode through two needles (the yarn laying digital is 0-1/2-1//), an elastic yarn passes across a guide needle of the second guide bar (GB2) and is knitted in a open double warp plain stitch loop mode in the same direction as the aforementioned non-elastic yarn, and two loops are continuously formed on each course of the open chain loop (the yarn laying digital is 0-2/3-1//), to form a hemming-stitch-free warp-knitted elastic fabric. The schematic structural diagram of the produced fabric is shown in FIG. 2.

A dyeing and finishing process includes: refining a knitted fabric in a steam cooker first to remove impurities on the fabric, make the fabric white and soft and have good penetrating properties, and prepare for subsequent dyeing, and then dehydrating the fabric for the first time through a vacuum dehydrator; after dehydration, entering into a tentering setting machine for presetting, and performing dyeing treatment through a sizing and dyeing combination machine; placing the dyed fabric in a dryer for drying, and finally subjecting a finished product to setting through a tentering setting machine. The steam cooker, the vacuum dehydrator, the tentering setting machine, the sizing and dyeing combination machine and the dryer described above are commercially available devices.

Embodiment 3

For a hemming-stitch-free warp-knitted elastic fabric provided by this embodiment, an adopted machine is a Karl Mayer HKS 2-S type tricot warp knitting machine with a machine number of E40. The number of guide bars is 2, and modes for threading are GB1/GB2 full-set threading.

Raw materials: a 22/34 dtex cotton thread matte straight yarn is selected for GB1, and a 22 dtex spandex yarn is selected for GB2.

A method for knitting a hemming-stitch-free warp-knitted elastic fabric provided by this embodiment includes: a non-elastic yarn passes across a guide needle of the first guide bar (GB1) and is knitted in a 2×1 closed warp plain stitch loop mode through three needles (the yarn laying digital is 1-0/2-3//), an elastic yarn passes across a guide needle of the second guide bar (GB2) and is knitted in a open double warp plain stitch loop mode in the same direction as the aforementioned non-elastic yarn, and two loops are continuously formed on each course of the open double warp plain stitch loop (the yarn laying digital is 0-2/3-1//), to form a hemming-stitch-free warp-knitted elastic fabric. The schematic structural diagram of the produced fabric is shown in FIG. 3.

A dyeing and finishing process includes: refining a knitted fabric in a steam cooker first to remove impurities on the fabric, make the fabric white and soft and have good penetrating properties, and prepare for subsequent dyeing, and then dehydrating the fabric for the first time through a vacuum dehydrator; after dehydration, entering into a tentering setting machine for presetting, and performing dyeing treatment through a sizing and dyeing combination machine; placing the dyed fabric in a dryer for drying, and finally subjecting a finished product to setting through a tentering setting machine. The steam cooker, the vacuum dehydrator, the tentering setting machine, the sizing and dyeing combination machine and the dryer described above are commercially available devices.

Embodiment 4

This embodiment differs from Embodiment 1 in that the fineness of the non-elastic yarn is 156 dtex, and the other knitting processes are the same as those of Embodiment 1.

The warp-knitted fabric produced by the knitting mode has a large gram mass of the fabric, is unsuitable for some soft close-fitting clothes, is more suitable for outerwear, and is coarse and hard in hand feeling.

Embodiment 5

This embodiment differs from Embodiment 1 in that the fineness of elastic yarn is 116 dtex, and the other knitting processes are the same as those of Embodiment 1.

In the warp-knitted fabric prepared by the knitting mode, a yellow spandex yarn is exposed at the bottom of the fabric, and the elongation of the warp-knitted fabric is greatly reduced and the fabric is too hard in hand feeling. It is difficult to roll up the knitted gray fabric, and the curling is serious.

APPLICATION EXAMPLE 1

Figure 4:
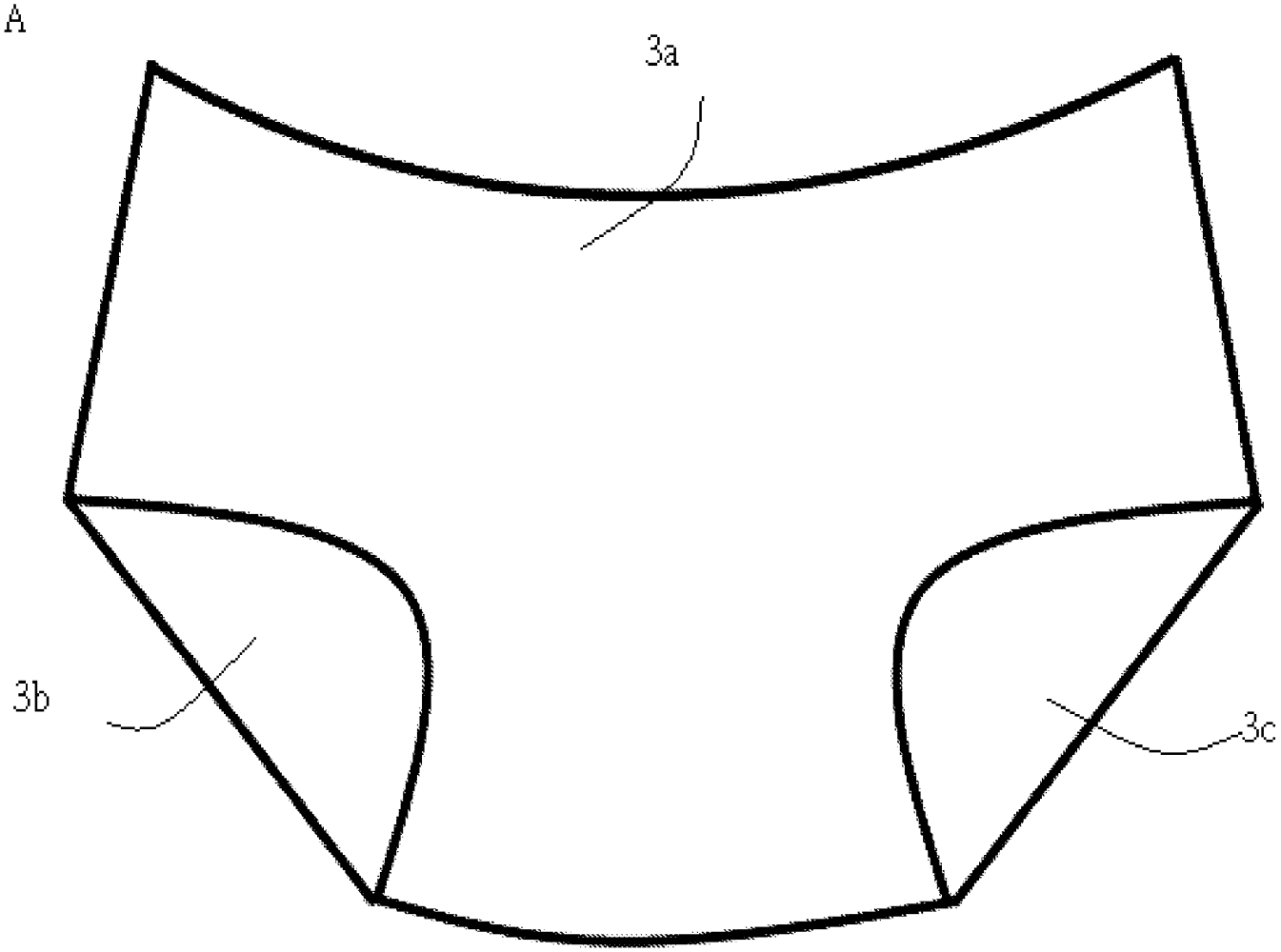
FIG. 4 is a schematic structural diagram of a side A of a pair of sports underpants according to Application Example 1 of the present invention, which uses a knitting method and fabric structure of Embodiment 1 of the present invention.
Figure 5:
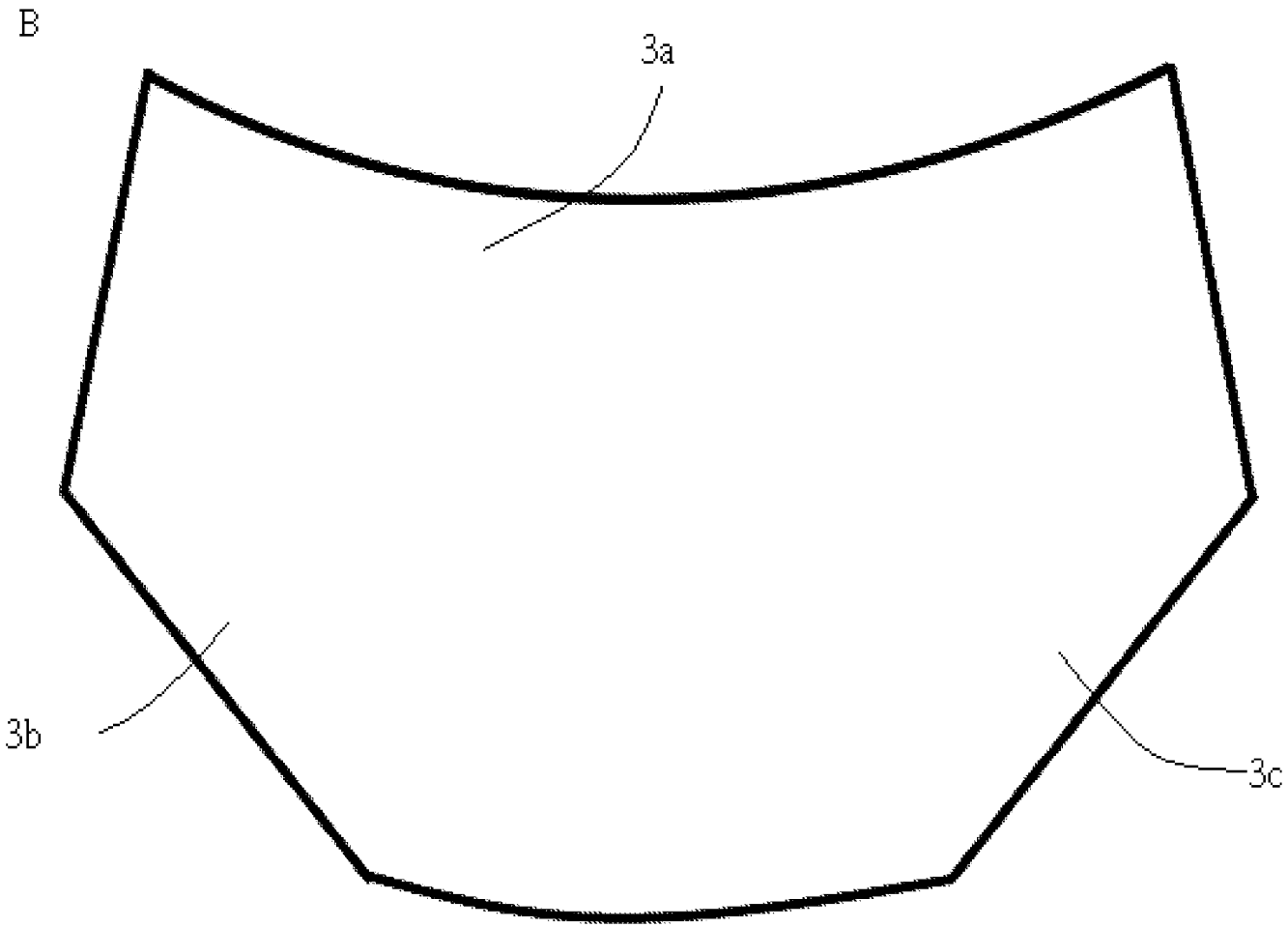
FIG. 5 is a schematic structural diagram of a side B of a pair of sports underpants according to Application Example 1 of the present invention, which uses a knitting method and fabric structure of Embodiment 1 of the present invention.

The hemming-stitch-free warp-knitted elastic fabric prepared in Embodiment 1 is woven into a pair of sports underpants including sides A and B, where the schematic structural diagram of the side A is shown in FIG. 4, and the schematic structural diagram of the side B is shown in FIG. 5. Edges of an apparel fabric where 3*a*, 3*b* and 3*c* are located do not need to be sewn, and the apparel fabric is not curled, is comfortable to wear, and has good wearability.

APPLICATION EXAMPLE 2

Figure 6:
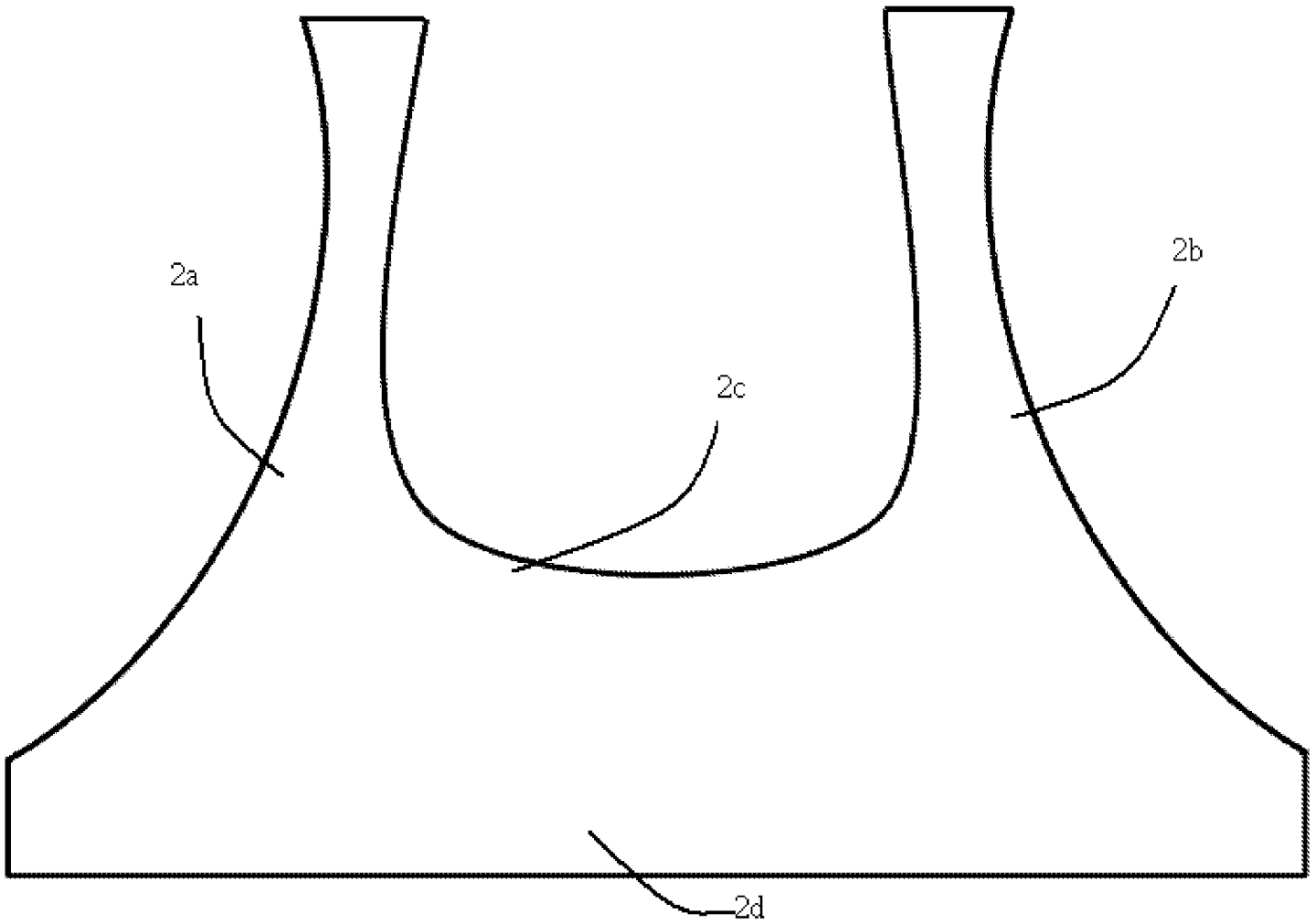
FIG. 6 is a schematic structural diagram of a piece of sports underwear according to Application Example 2 of the present invention, which uses a knitting method and fabric structure of Embodiment 2 of the present invention.

The hemming-stitch-free warp-knitted elastic fabric prepared in Embodiment 2 is woven into a pair of sports underpants with a schematic structural diagram as shown in FIG. 6, where edges of the apparel fabric where 2*a*, 2*b*, 2*c* and 2*d* of a sports garment piece do not need to undergo hemming-stitch, and a garment also does not need to undergo heat bonding processing, is comfortable to wear and has good wearability.

COMPARATIVE EXAMPLE 1

This comparative example differs from Embodiment 1 in that the elastic yarn is knitted in a 2-0// knitting structure mode, and the other knitting processes are the same as those of Embodiment 1.

The warp-knitted fabric produced by the knitting mode still has the characteristics of being free of hemming-stitch, but the hand feeling of the cloth cover will deteriorate, and the hemming-stitch-free warp-knitted elastic fabric produced will have poor cloth cover elasticity due to structural changes.

COMPARATIVE EXAMPLE 2

This comparative example differs from Embodiment 1 in that the elastic yarn is prepared in a 2-0/0-2// knitting structure mode, and the other knitting processes are the same as those of Embodiment 1.

The warp-knitted fabric produced by the knitting mode still has the characteristics of being free of hemming-stitch, but the hand feeling of the cloth cover will deteriorate, and the hemming-stitch-free warp-knitted elastic fabric produced will have poor cloth cover elasticity due to structural changes.

COMPARATIVE EXAMPLE 3

This comparative example differs from Embodiment 1 in that the non-elastic yarn and the elastic yarn are knitted in a different-direction knitting structure mode, and the other knitting processes are the same as those of Embodiment 1.

The warp-knitted fabric produced by using the knitting mode has a good hand feeling of the cloth cover, but the obtained hemming-stitch-free warp-knitted elastic fabric is subjected to edge curling due to the structural change when cut, and does not have the advantage of being free of hemming-stitch.

COMPARATIVE EXAMPLE 4

This comparative example differs from Embodiment 1 in that the non-elastic yarn passes across a guide needle of the first guide bar and is knitted in a 1×1 closed warp plain stitch loop mode through two needles (the yarn laying digital is 2-3/1-0//), and the elastic yarn passes across a guide needle of the second guide bar and is knitted in a closed double warp plain stitch loop mode in the same direction as the aforementioned non-elastic yarn (the yarn laying digital is 1-3/2-0//), to form a gray fabric of the warp-knitted fabric.

The hemming-stitch-free warp-knitted elastic fabric produced by using the knitting mode is subjected to edge curling due to the structural change when cut, and does not have the advantage of being free of hemming-stitch.

COMPARATIVE EXAMPLE 5

A method for knitting a warp-knitted fabric in the prior art is as follows: a non-elastic yarn passes across a guide needle of the first guide bar and is knitted in a 1×1 open warp plain stitch loop mode through two needles (the yarn laying digital is 0-1/2-1//), and the elastic yarn passes across a guide needle of the second guide bar and is knitted in a open double warp plain stitch loop mode in the same direction as the aforementioned non-elastic yarn (the yarn laying digital is 0-1/2-1//), to form a gray fabric of the warp-knitted fabric.

The hemming-stitch-free warp-knitted elastic fabric produced by using the knitting mode has the advantage of being free of hemming-stitch and is good in elasticity, but since an ordinary two-needle open warp plain stitch loop structure is adopted for the GB1/GB2, the defects of the structure make the fabric ravelled easily, and once a loop breaks, the whole fabric is divided into two. The ravelling refers to the phenomenon that loops are separated from each other when a yarn of a knitted fabric breaks or loses an interlacing connection; and once a loop breaks, the wales will be ravelled from top to bottom, causing one fabric to be divided into two.

Fabric structures obtained in all embodiments and comparative examples are experimentally tested.

(1) Tensile Property

Referring to the LTD-03 tensile force test method (Victoria's Secret customer-specific test), this standard is to test the elongation of the woven or knitted elastic fabric under the agreed tensile force; the test sample size was 9×3 inches, fabrics of embodiments and comparative examples were taken in the horizontal direction and the longitudinal direction, the tensile force instrument used was a Zwick/Roell's H01-LLJ-004 tensile machine, using a force of 7.5 lb, with an intermediate clamping distance of 127 mm and a stretching speed of 20 in/min, and the cycle stretch was performed twice.

(2) Snagging Performance

Referring to the test method of BS-8479 Method for Determining Textile Spinning Tendency—Rotating Chamber Method, fabrics of the embodiments and the comparative examples were tested by snagging under the James Heal Snagging Tester instrument. The test sample size was 140×140 mm. The test samples underwent forward rotation for 50 turns at a speed of 60 r/min, and underwent reversal rotation for 50 turns; the cycle was performed 10 times, 1000 turns were performed in total, and then the samples were taken out and compared with a standard grading picture to obtain snagging grades. There are grades 1-5, grade 5 is the best, and grade 1 is the worst.

(3) Hand Feeling

Three textile industry technicians were selected to make a touch feeling on these three fabrics, and comprehensively evaluate the hand feeling of the fabrics. There are grades 1-5, and grade 5 is the best.

(4) Resilience

Referring to the LTD-03 tensile force test method (Victoria's Secret customer-specific test), this standard is to test the elongation of the knitted elastic fabric under the agreed tensile force; the test sample size was 9×3 inch, fabrics of embodiments and comparative examples were taken in the horizontal direction and the longitudinal direction, the tensile force instrument used was a Zwick/Roell's H01-LLJ-004 tensile machine, using a force of 7.5 lb, with an intermediate clamping distance of 127 mm and a stretching speed of 20 in/min, and the cycle stretch was performed twice, where a value of 85% or above of resilience can be considered as being qualified.

The elongation properties, snagging, hand feeling and resilience of the finished fabrics obtained in Embodiments 1-5 and Comparative Examples 1-3 were evaluated. The results are shown in Table 1.

TABLE 1

| | Lengthwise | | Snagging (grade) | Hand feeling (grade) | Resilience (%) |
|---|---|---|---|---|---|
| Embodiment 1 | Lengthwise | 127 | 3.5 | 4 | 90 |
| | Widthwise | 270 | 3 | | 95 |
| Embodiment 2 | Lengthwise | 132 | 3 | 4 | 92 |
| | Widthwise | 196 | 3.5 | | 95 |
| Embodiment 3 | Lengthwise | 243 | 3 | 3.5 | 96 |
| | Widthwise | 150 | 3 | | 92 |
| Embodiment 4 | Lengthwise | 79 | 2.5 | 2 | 86 |
| | Widthwise | 120 | 2 | | 86 |
| Embodiment 5 | Lengthwise | 50 | 2.5 | 2 | 90 |
| | Widthwise | 90 | 2 | | 89 |
| Comparative Example 1 | Lengthwise | 70 | 2.5 | 2 | 78 |
| | Widthwise | 98 | 2 | | 75 |
| Comparative Example 2 | Lengthwise | 70 | 2.5 | 2.5 | 70 |
| | Widthwise | 88 | 2 | | 72 |
| Comparative Example 3 | Lengthwise | 90 | 1.5 | 4 | 82 |
| | Widthwise | 123 | 1.5 | | 83 |
| Comparative Example 4 | Lengthwise | 163 | 2 | 2.5 | 78 |
| | Widthwise | 110 | 2 | | 80 |
| Comparative Example 5 | Lengthwise | 150 | 3 | 3.5 | 90 |
| | Widthwise | 189 | 2.5 | | 90 |

It can be seen from Table 1 that the three hemming-stitch-free structures provided by the present invention are optimal in terms of elongation, hand feeling, resilience, snagging grade and the like, and the fabric has superior comprehensive property and is suitable for development of various products. In Comparative Example 1 and Comparative Example 2, the warp-knitted fabric prepared by using the elastic yarn chain exchange double loop stitch structure still has the characteristics of being free of hemming-stitch, but the hand feeling of the cloth cover will deteriorate, and the hemming-stitch-free warp-knitted elastic fabric produced will have poor cloth cover elasticity due to structural changes. Reverse yarn laying movement is performed for Comparative Example 3; and although the hand feeling is maintained, the requirements for free cutting are not met, and the snagging is relatively poor. Comparative Example 4 used the same-direction closed double loop stitch structure, but the fabric is not good in elasticity, poor in hand feeling and does not have the characteristic of being free of hemming-stitch. An ordinary two-needle open warp plain stitch structure is adopted for GB1/GB2 of Comparative Example 5, the elongation and hand feeling are good, but the defects of the structure make the fabric raveled easily, and once a loop breaks, the whole fabric is divided into two. In summary, the present invention is superior to the prior art in terms of structure and properties of finished fabrics.

The hemming-stitch-free warp-knitted elastic fabric provided by the present invention has good resilience, can be arbitrarily cut, does not ravel easily, is free of hemming-stitch and has good elongation, snagging grade and hand feeling. Only by means of a knitting structure, the method for knitting the hemming-stitch-free warp-knitted fabric maintains an original cutting state without edge processing, without laser cutting and without heating bonding processing. The fabric can be produced by ordinary electric shears, and thus the cost is greatly reduced.

The above contents are merely preferred embodiments of the present invention, and for those of ordinary skill in the art, changes can be made on specific embodiments and application scopes according to the idea of the present invention. The content of the present specification should not be construed as limiting the present invention.

What is claimed is:

1. A method for knitting a hemming-stitch-free warp-knitted elastic fabric, which uses a first guide bar and a second guide bar of a warp knitting machine for knitting, comprising:

making a non-elastic yarn pass across a guide needle of the first guide bar and form the surface of the fabric by knitting in a 1×1 closed warp plain stitch loop mode through two needles with a yarn laying digital of 1-0/1-2// or in a 2×1 closed warp plain stitch loop mode through three needles with a yarn laying digital of 1-0/2-3//, and making an elastic yarn pass across a guide needle of the second guide bar and form the inside of the fabric by knitting with the aforementioned non-elastic yarn in the same direction in an open double warp plain stitch loop mode, and two loops are continuously formed on each course of the open double warp plain stitch loop with a yarn laying digital of 0-2/3-1//.

2. The method according to claim 1, wherein modes for threading of the first guide bar and the second guide bar are full-set threading.

3. The method according to claim 1, wherein the non-elastic yarn is a synthetic fiber and/or a natural fiber having a fineness of 11-85 dtex.

4. The method according to claim 3, wherein the synthetic fiber is at least one of a nylon filament, a polyester filament, and a cotton thread.

5. The method according to claim 1, wherein the elastic yarn is a spandex yarn having a fineness of 22-77 dtex.

6. The method according to claim 1, wherein the non-elastic yarn is knitted via two needles.

7. The method according to claim 1, wherein the non-elastic yarn is knitted via three needles.

8. A fabric, wherein the fabric is produced by using the method of claim 1.

9. A garment, wherein at least a portion of a linear edge and/or at least a portion of a curved edge of the garment is composed of the fabric of claim 8.

* * * * *